United States Patent [19]

Shibauchi et al.

[11] Patent Number: 5,076,039

[45] Date of Patent: Dec. 31, 1991

[54] METHODS AND MEANS FOR LID STERILIZATION AND TEMPORAL SEALING

[75] Inventors: Yoshito Shibauchi; Kohichi Hatanaka; Tatsuo Tanaka, all of Saitama; Katsuyuki Mogi; Tadashi Hanada, both of Kanagawa, all of Japan

[73] Assignees: Snow Brand Milk Products Co., Ltd., Sapporo; Yoshino Kogyosho Co., Ltd., Tokyo, both of Japan

[21] Appl. No.: 552,994

[22] Filed: Jul. 16, 1990

Related U.S. Application Data

[62] Division of Ser. No. 321,870, Mar. 10, 1989, Pat. No. 4,981,649.

[30] Foreign Application Priority Data

Mar. 25, 1988 [JP] Japan ..... 63-71310
Jun. 15, 1988 [JP] Japan ..... 63-147314

[51] Int. Cl.[5] ..... B65B 7/28; B65B 51/14

[52] U.S. Cl. ..... 53/478; 53/329.3; 53/485

[58] Field of Search ..... 53/426, 425, 478, 485, 53/300, 329.3, 329.4, 329.2; 156/583.91, 583.1

[56] References Cited

U.S. PATENT DOCUMENTS

| | | | |
|---|---|---|---|
| 3,714,758 | 2/1973 | Vogeleer | 53/478 X |
| 3,908,340 | 9/1975 | Erhardt | 53/329.3 X |
| 3,971,188 | 7/1976 | Cawrse | 53/478 |
| 4,565,052 | 1/1986 | Hautemont | 53/300 X |
| 4,750,312 | 6/1988 | DeVaujany | 53/329.3 X |
| 4,862,933 | 9/1989 | Gies | 53/426 X |

FOREIGN PATENT DOCUMENTS 59-115221 7/1984 Japan .

*Primary Examiner*—James F. Coan
*Attorney, Agent, or Firm*—Oliff & Berridge

[57] ABSTRACT

The present invention provides methods and means for lid sterilization and temporal sealing. With the lid sterilization means, a lid's whole surface is completely sterilized, while it is held and revolved, and the lid then is put on the opening of a container which is hung by a flange on a pair of rails and carried by a pushing plate. With the temporal sealing means, the lid is partially pushed on the flange by a heater and is briefly and temporarily sealed.

7 Claims, 16 Drawing Sheets

METHODS AND MEANS FOR LID STERILIZATION AND TEMPORAL SEALING

This is a division of application Ser. No. 07/321,870 filed Mar. 10, 1989, now U.S. Pat. No. 4,981,649.

BACKGROUND OF THE INVENTION

So-called fill-and-pack in a non-germ atmosphere methods are frequently desirable in comparison to regular methods. The fill-and-pack in the non-germ atmosphere method may involve sterilizing food prior to filling the food into a container and then sealing the container with a lid in a non-germ atmosphere. The container and the lid are also sterilized beforehand. Regular methods, on the other hand, invole filling and packing in a clean atmosphere, which contains germs, and sterilizing the food and the container together by applying heat or hot water thereafter.

The former method is considered better than the latter one for the following reasons:

(1) Food is sterilized with high temperature in a very short time, therefore the quality of the food remains good for a long time.

(2) Since food is sterilized and filled in a sterilized container, it contains no germs and therefore will not rot even if it is kept long time at normal temperatures.

(3) Keeping food cold is not necessary, so that otherwise needed for cooling the food can be saved.

(4) Food can be filled in a bigger container than a can for canned food. Thus it is more economical.

(5) Food can be saved in a warehouse and on a shelf for a long time, thus production of the food can be well planned.

(6) The container is sterilized by means other than heat before the food is filled, therefore heat-proofing is not required.

There are at least two ways to complete the method for fill-and-pack in the non-germ atmosphere: one is to seal the container with a film-like lid material and cut it to a lid shape thereafter; the other is to seal the container with a lid that has previously been cut or punched to a lid shape.

The former type, however, has a number of problems. For example, it is extremely difficult to keep the non-germ atmosphere of the apparatus since it is necessary to create an open passage between the inside and the outside of the apparatus to supply the film-like lid material. Therefore, the latter type is considered more convenient.

The latter type—previously cut a lid in shape—is described in Japanese patent application No. 54-115221. In this invention, each lid is held by a rod which moves by an endless chain, and as the lid moves it is sterilized, dried and then supplied on the container for sealing. After the lid is put on the container, it moves to a next step and there the lid is pressed by hot heat and sealing is completed.

The problem of this invention, however, is that since the container moves with a lid to the next hot press step, the lid often moves from the first set position and the lid then can be sealed on the wrong distorted position. This could produce incompletely sealed products having a poor appearance.

The Japanese patent No. 57-193602 attempts to resolve the above-mentioned problems by including means that correct the position of the lid put on the container, and other means that temporarily seal the lid onto the container by pressing hot heat on some spots of the lid.

However, this invention also has a number of problems to be solved. They are as follows.

(1) In the lid sterilizing process, the lid holder's capacity is limited to holding only one shape of lid, Thus when a different shape of lid is supplied, all of the lid holders have to be replaced by another type. Moreover, when replacing the lid holders, the non-germ atmosphere may be disrupted. Both replacing the lid holders and recreating the non-germ atmosphere take time and money.

(2) Since a part of the endless chain takes place outside of the apparatus maintaining a non-germ atmosphere is extremely difficult. Preventing hydrogen peroxide gas, which is used for sterilization, from entering into the non-germ atmosphere is also difficult.

To prevent the disruption of the non-germ atmosphere, it is necessary to keep the pressure of the passage that connects the outside, the sterilizing room and the non-germ atmosphere room, higher than outside to prevent the outside air from flowing to the inside. Also it is necessary to prevent the hydrogen peroxide gas from entering into the non-germ atmosphere room or leaking to the outside. At the same time, keeping the hydrogen peroxide gas in the sterilizing room for a certain period of time is essential to adequately sterilize the lid. Unfortunately, all of these requirements cannot well be accomplished by the prior art.

(3) Since the hydrogen peroxide gas cannot be kept in the room for longer than a certain period of time, density of the gas is required to be up to about 50 percent for instance. As a result, the gas could remain on the lid and the food could be deteriorated.

(4) Since the lid holder does not possess the ability to move means that can move the lid from one place to another is included. As a result, the structure of the apparatus is more complicated and moreover correct positioning of the lid on the container is difficult to achieve.

It is possible to include means that correct the lid's position, but this makes the structure of the apparatus complicated and costly.

(5) While the lid is held by the holder, the sterilizing and the drying processes are carried out. Therefore, at least part of the lid is held and thus hidden by the holder so that it cannot adequately be sterilized or dried.

(6) The means for correcting the lid's position and for sealing the lid temporarily are mechanically connected. Thus, when a differently shaped lid is supplied, the means has to be adjusted by hand. While adjusting, therefore, the non-germ atmosphere will be disrupted. It takes time and work for recreate the non-germ atmosphere.

OBJECTS OF THE INVENTION

The first object of the present invention, therefore, is to provide means that accomplishes the sterilization of the lid in a completely sealed room with its entrance and exit passages arranged to close the room.

Another object is to present an apparatus that can handle differently shaped lids without changing any parts.

Another object of the invention is to supply a lid on the right place of the container.

Another object is to completely sterilize the whole surface of the lid.

Another object is to eliminate the need for providing in the a means for correcting the lid's position relative to the container.

And, still another object is to present simple means that temporarily seals a lid on the container.

DETAILED DESCRIPTION OF THE INVENTION

Figure 1:
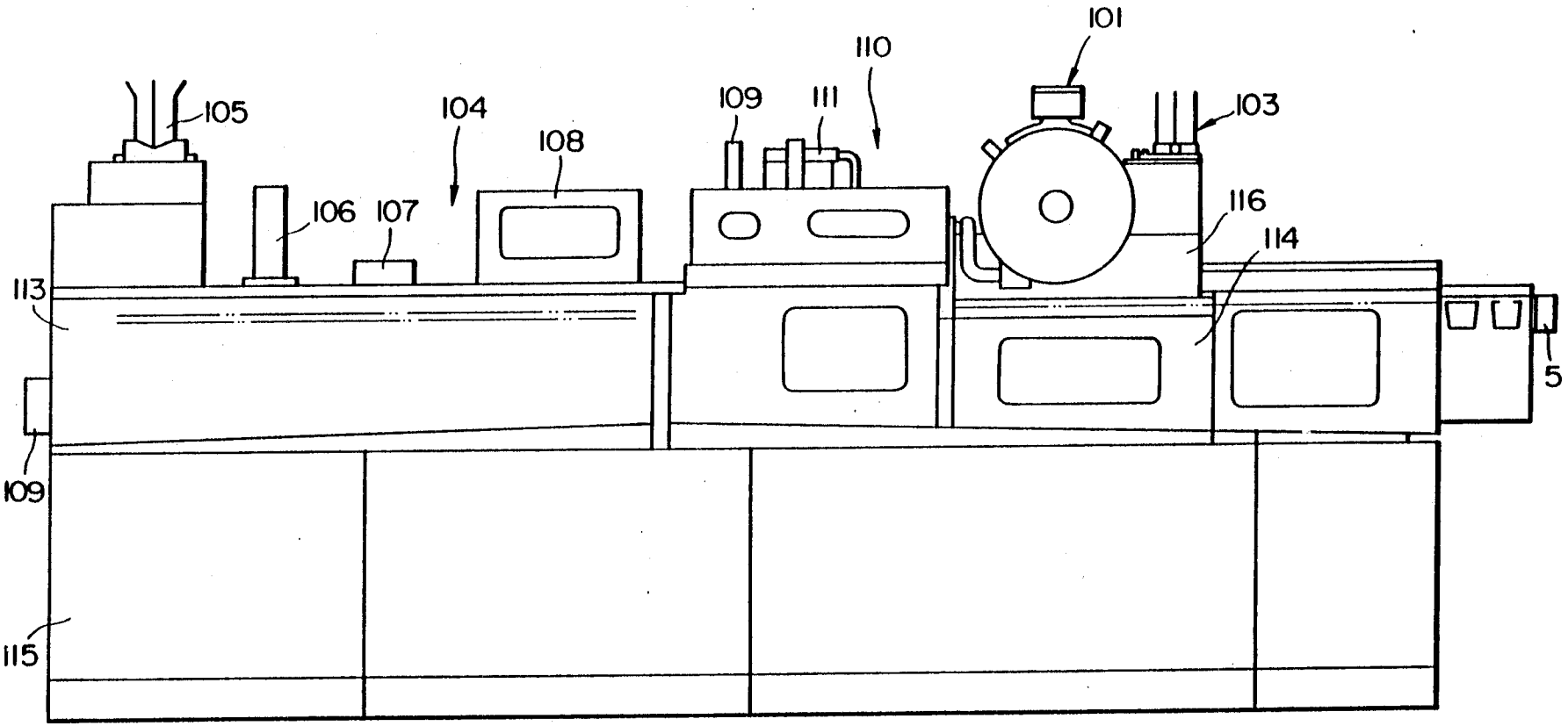
FIG. 1 is an elevational view of the machine for fill-and-pack in a non-germ atmosphere according to the present invention in which, means for lid sterilization and temporal sealing are included.

The details of the present invention will be explained below referring to the drawings.

FIG. 1 shows a fill-and-pack in a non-germ atmosphere machine according to the present invention. The machine is composed of a container sterilization unit 104 and a fill-and-pack unit 110.

Figure 12:
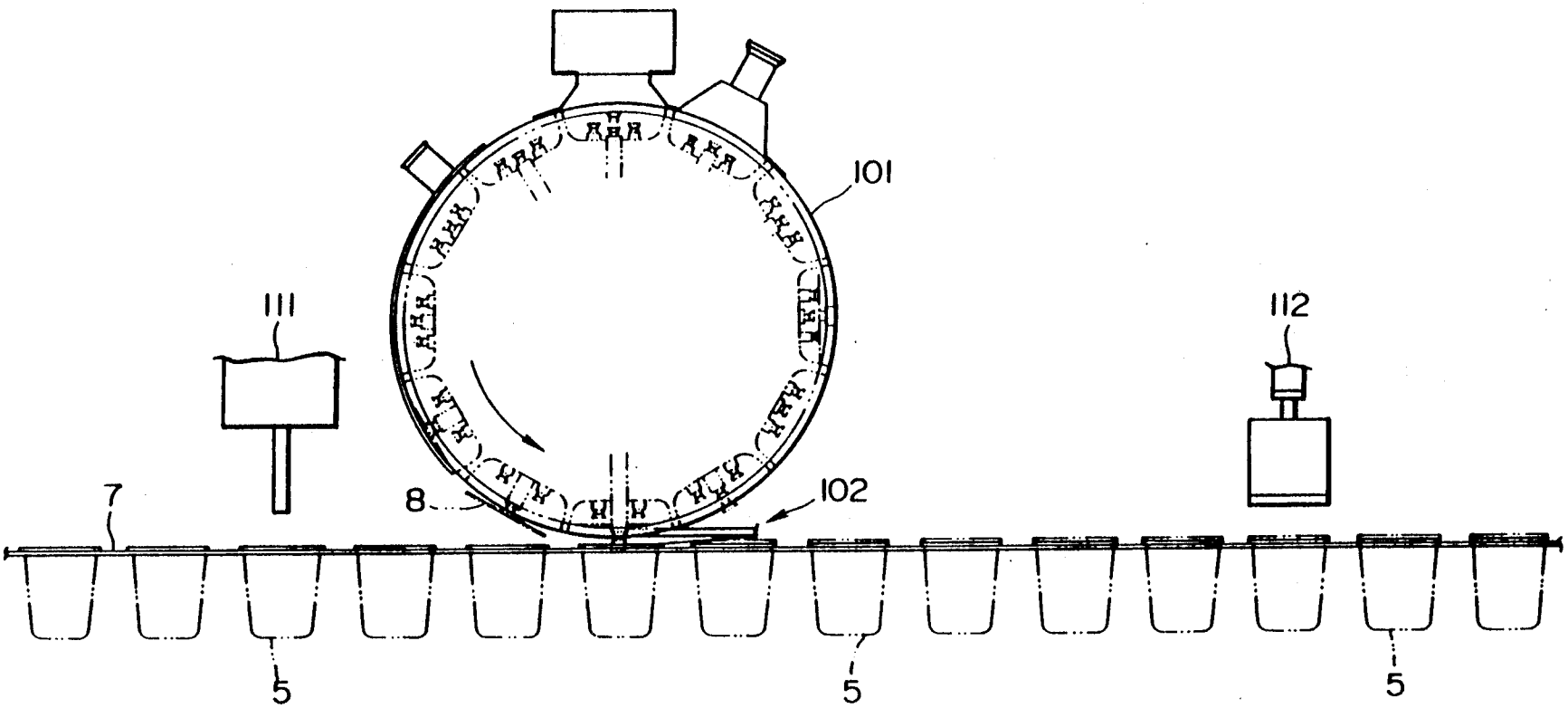
FIG. 12 is an elevational view of a device according to the present invention with other means included.
Figure 13:
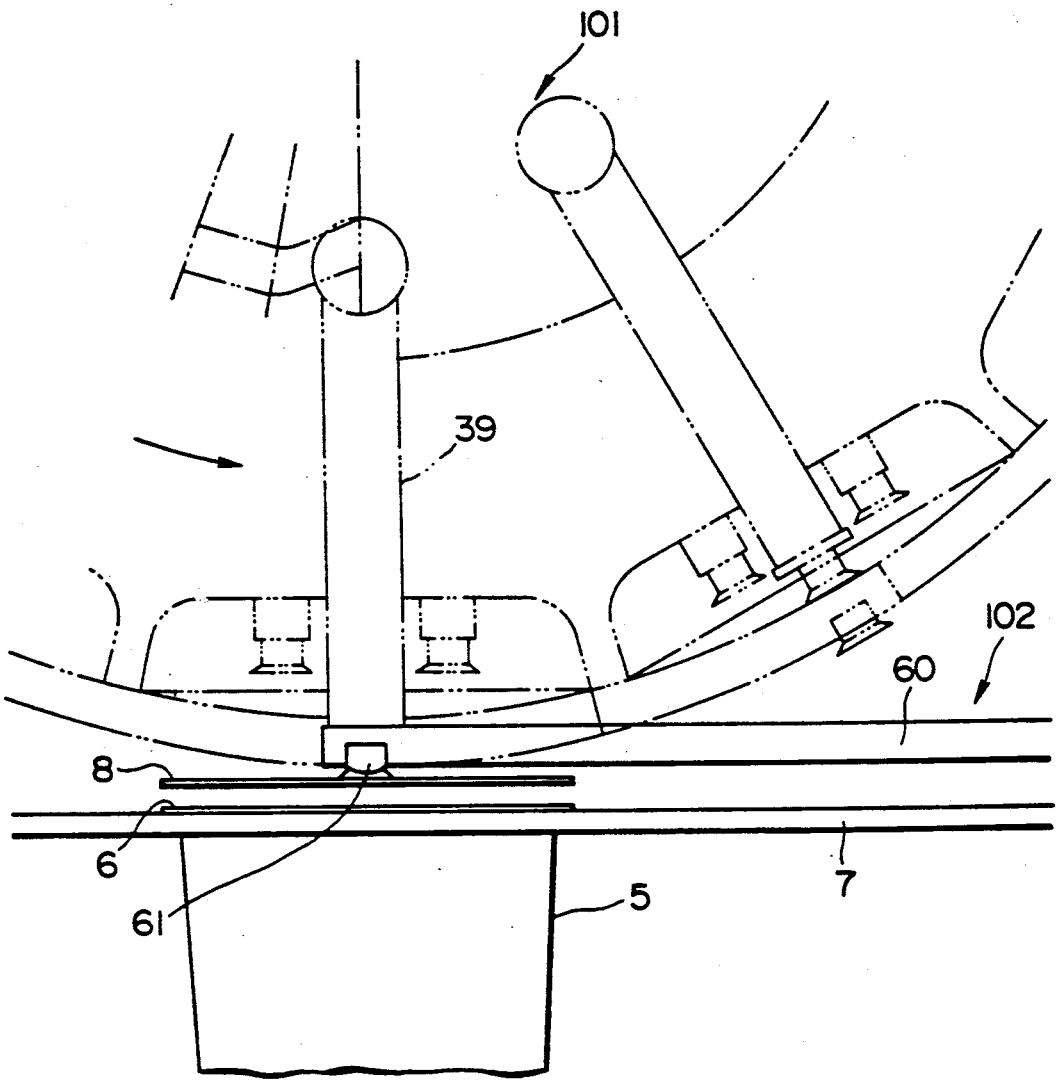
FIG. 13 is a elevational view of a device according to the present invention.

The container sterilization unit 104 is composed of a sealed framework 113 (non-germ chamber) positioned on the supporting framework 115. In the sealed framework 113, the container supplier 105, the sterilizer dispatching mouth 106, the ultraviolet ray applying means 107, the hot wind blow duct 108 and the hot wind sucking duct 109 are positioned. At least a pair of rails 7 (See FIG. 12) is installed in the sealed framework 113 and containers 5 are hung at their flanges 6 (See FIG. 13) by the rail 7. The endless chain is installed to move intermittetly under the rail 7 and pushing plates are secured to the endless chain at intervals corresponding to the intermittent motion. Each pushing plate pushes a container 5 hung on the rail 7 freely and sends it forward.

Figure 2:
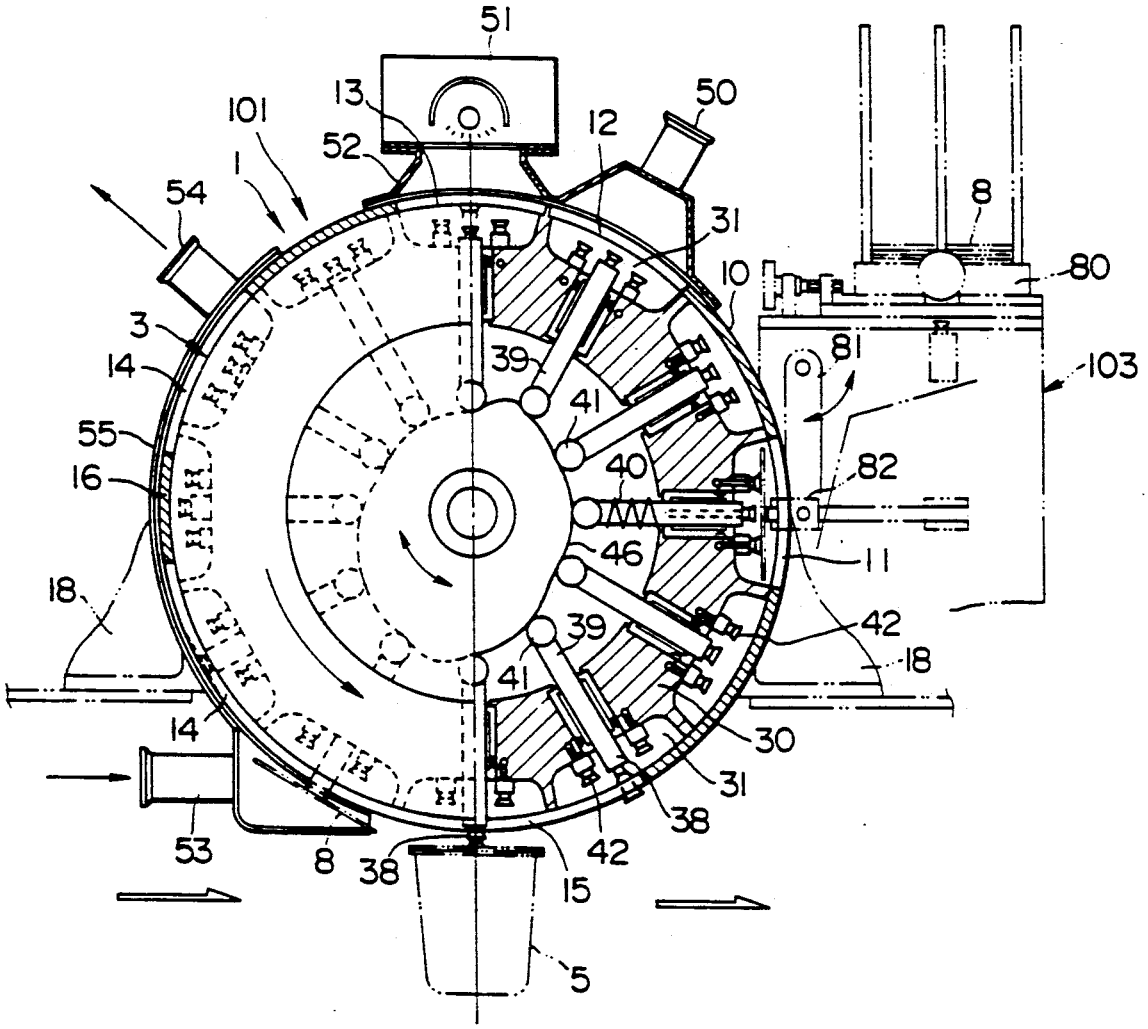
FIG. 2 is a elevational view, partly in section, of a preferred embodiment of a lid sterilization means according to the present invention.

Each container 5 is first sterilized with a sterilization agent such as hydrogen peroxide applied through the sterilizer apply mouth 12, and ultraviolet are applied from the ultraviolet ray applier 51 (See FIG. 2) after which the container 5 is completely dried by hot wind. After the sterilization is completed, the container 5 is sent to the fill-and-pack unit 110.

The fill-and-pack unit 110 comprises a shut framework 114 (sealed non-germ chamber) on the supporting framework 115. In the shut framework 114, the filling means 111, the lid sterilization means 101 and the press seal means 112 are installed (See FIG. 12). In the same shut framework 114, the temporal sealing means 102, the first positioning means (not shown in the drawings) that corrects the 5 position of each container 5 where a lid 8 is provided for each container on, and the second positioning means (not shown in the drawings) that corrects the position of each container and supports the container's flange 6 from underneath where it is pressed by the press seal means 112 for a complete sealing, are also installed.

Each container 5 sent from the container sterilization unit 104 is carried intermittently in the fill-and-pack unit 110 with its flange 6 hung on the rail 7 until it arrives underneath the filling means 111. There the container is filled with food. Then the container 5 with the food filled therein is again carried underneath the lid sterilization means 101. After the container's position is adjusted by the first positioning means, a lid 8 is provided on the top of the container 5 from the lid sterilization means 101 and the lid 8 is partially sealed on the top of the container 5 by the temporal sealing means 102. Then the container 5 with the lid 8 on the top is sent beneath the press seal means 112. After the container's position is corrected by the second positioning means, the lid 8 is pressed by the press seal means 112, completing the seal of the container. The container 5 is, then sent outside of the sealed framework 113.

As shown in FIGS. 2 through 11, the lid sterilization means 101, a part of the present invention, is composed of the outer cylinder 1 which is secured by the bracket 18 to the frame wall 116 of the sealed framework 113, and the rotary drum 3 which is rotatably installed to the outer cylinder 1.

Figure 4:
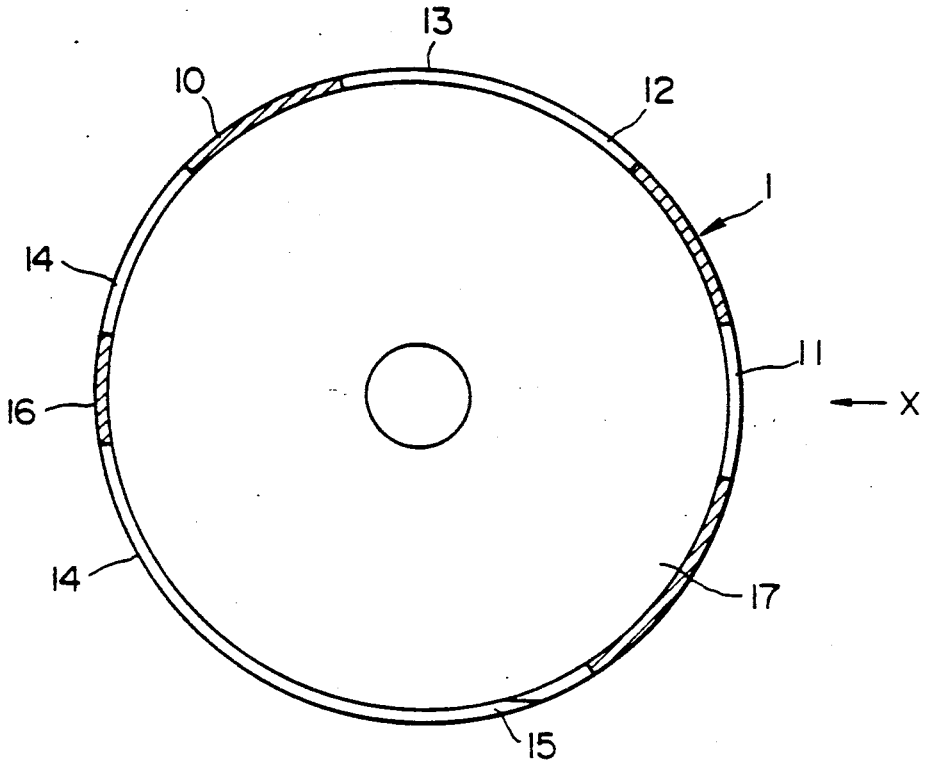
FIG. 4 is a elevational view in section of an outer cylinder 1 shown in FIG. 2.
Figure 5:
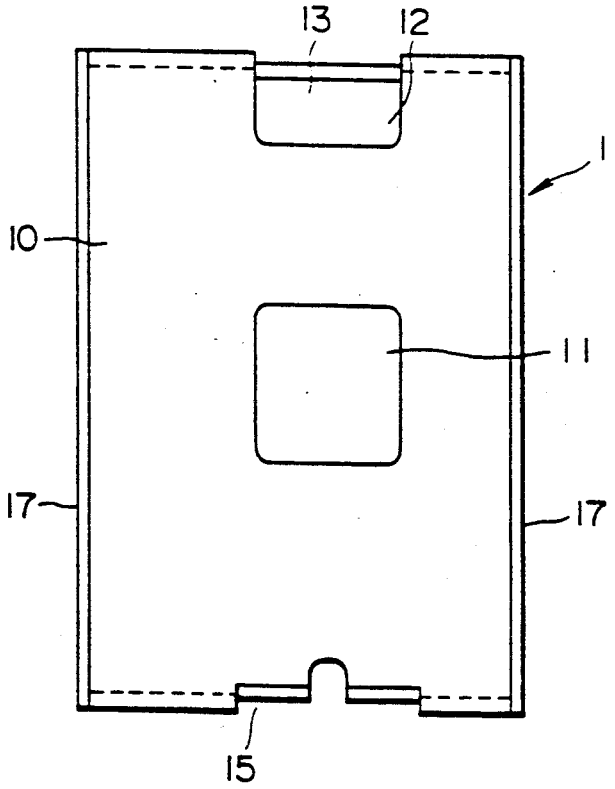
FIG. 5 is a side elevational view of the outer cylinder 1 shown in FIG. 4.

The outer cylinder 1, as shown especially in FIGS. 4 and 5, comprises the wall cylinder 10 the inside surface of which is smooth, and the sides wall 17 that closes both side of the openings of the wall cylinder 10. The wall cylinder 10 has a carry-in mouth 11 for carrying the lid 8 in, a sterilizer apply mouth 12, an ultraviolet ray apply mouth 13, a hot wind passage mouth 14, and a carry-out mouth 15 for carrying out the sterilized lid 8.

Figure 6:
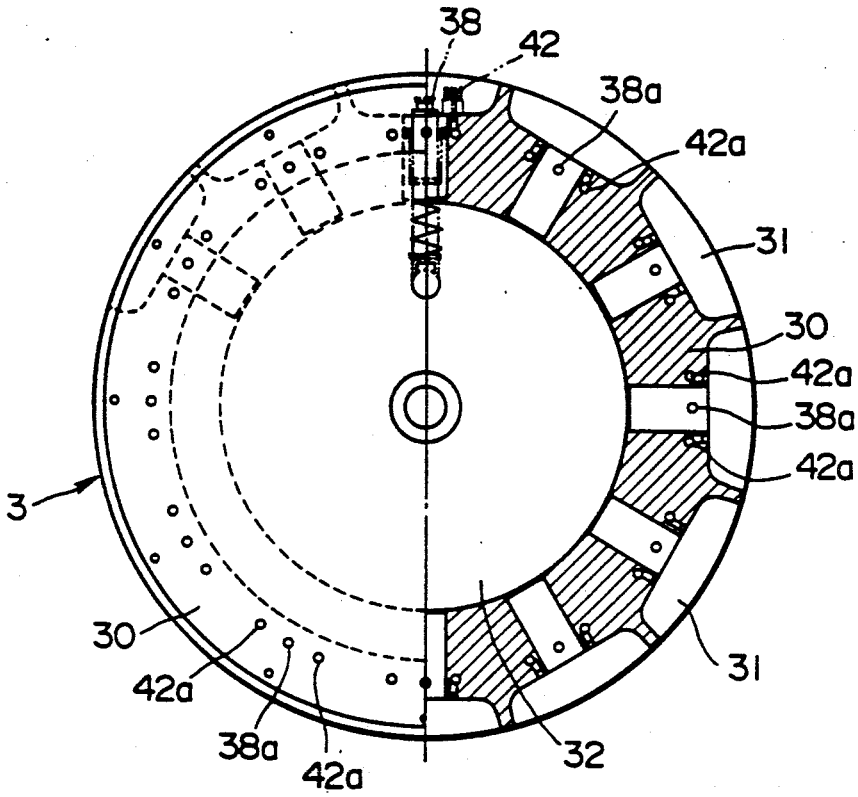
FIG. 6 is an elevational view in section of a rotary drum 3 shown in FIG. 2.
Figure 7:
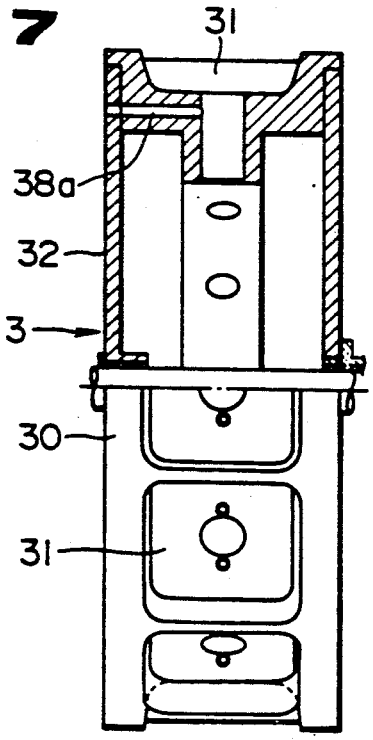
FIG. 7 is a side elevational view in section of the rotary drum 3 shown in FIG. 6.

As especially clearly shown in FIGS. 6 and 7, the rotary drum 3, which rotates intermittently by regular angular amounts of, is composed of the cylindrically shaped main drum 30 an, outer surface of which touches closely the inner surface of the cylindrically shaped wall cylinder 10, rooms 31 spaced by similar regular angular amounts on the outer surface of the main drum 30, the side plates 32 that close both opening sides of the main drum 30, the second sucking disk 42 which is firmly fixed on the bottom of the room 31 (see FIG. 2), and the first sucking disk 38 (see also FIG. 2) which can move upwardly and downwardly through the bottom wall of the room 31.

The shape of the carry-in mouth 11 is arranged similar to that of the room 31. A lid 8 is provided to the right position from the lid supply means 103 into the room 31 through the carry-in mouth 11. When the room 31 revolves and stops by the carry-in mouth 11, the move arm 81 moves and the vacuum pat 82 holds the bottom lid 8 stocked in the lid magazine 80. The move arm 81 moves into the room 31 and provides the lid 8 to the second sucking disk 42.

A room 31 is located between the carry-in mouth 11 and the sterilizer apply mouth 12, so that, the inside of the lid sterilization means 101 is successfully shut from the outside.

The sterilizer apply mouth 12 and the ultraviolet rays apply mouth 13 are positioned near each other to continuously complete sterilization and application of ultraviolet rays.

Another room 31 is located between the ultraviolet rays apply mouth 13 and the hot wind passage mouth 14 to prevent the sterilization agent from leaking into the hot wind passage mouth 14. The hot wind passage mouth 14 is interconnected with four rooms 31. Hot wind blows through all these four rooms 31, thus the lids 8 can well be dried. The partial wall 16 is provided at about the middle of the hot wind passage mouth 14 to fully apply hot wind to the back side of the lid 8.

The carry-out mouth 15 is positioned next to the hot wind passage mouth 14. There is no blocking element between them. Therefore, the first sucking disk 38 with the lid 8 can move outward (in the downward direction at this position) and provide the lid 8 on the top of the container 5.

At least one room 31 is located between the carry-out mouth 15 and the carry-in mouth 11 to block the passage between them.

The sterilizer apply duct 50 is installed to the sterilizer apply mouth 12, and the ultraviolet rays applier 51 is installed with the shade cover 52 to the ultraviolet rays apply mouth 13.

The hot wind passage mouth 14 is sealed by the cover plate 55. The hot wind supply duct 53 is installed at one side of the cover plate 55 and the hot wind exhaust duct 54 is installed at the other side of the cover plate 55. Hot wind, supplied from the hot wind supply duct 53, blows through each room 31 and is exhausted from the hot wind exhaust duct 54.

Figure 3:
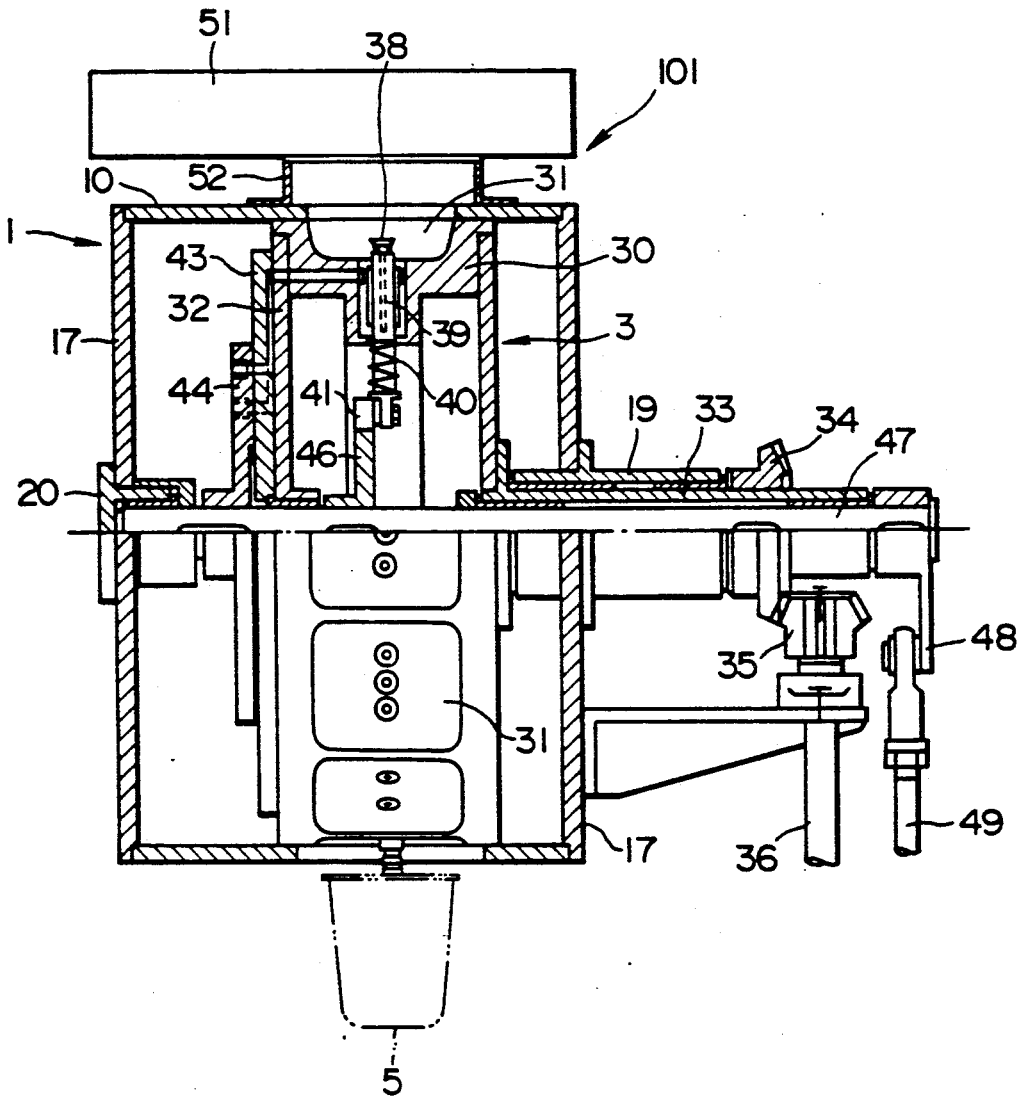
FIG. 3 is a sectional side elevational view of the embodiment shown in FIG. 2.

As shown especially in FIG. 3, the bearing boss 19 and the bearing 20 are installed to the frame wall 116 by the bracket 18. They organize the central element of parts such as the rotary drum 3, the cam plate 46 and the vacuum disk 44.

The rotary drum 3, firmly secured to the rotary shaft sleeve 33 which is installed to the bearing boss 19, rotates intermittenly with force transmitted through the drive shaft 36, the drive gear 35 and the follower gear 34.

The cam plate 46 and the vacuum disk 44 are fixed to the cam driving shaft 47 which is rotatably installed into the rotary shaft sleeve 33. The cam plate 46 forces the first sucking disk 38 to move upwardly and downwardly. The vacuum disk 44 interconnects and disconnects the vacuum chamber (not shown) to both first sucking disk 38 and the second sucking disk 42. The cam plate 46 and the vacuum disk 44 rotate in one direction and in the return direction together when the rotary arm 48 is driven by the up-down shaft 49.

The first sucking disk 38 is installed on top of the pickup rod 39 airtightly and moveably upward and downward the pickup rod passing through the main drum 30. The spring 40 is installed to the pickup rod 39, one side of which touches the cam wheel 41 and the other to the main drum 30. The cam wheel 41 is caused to touch the cam plate's 46 surface by the elasticity of the spring 40.

The vacuum manifold 43, placed airtightly, touches the vacuum disk 44, and is firmly secured to the side plate 32. The interconnection between the sucking disks 38, 42 and the vacuum chamber (not shown in the drawings) is accomplished by the mutual rotation of the vacuum manifold 43 and the vacuum disk 44.

Figure 8:
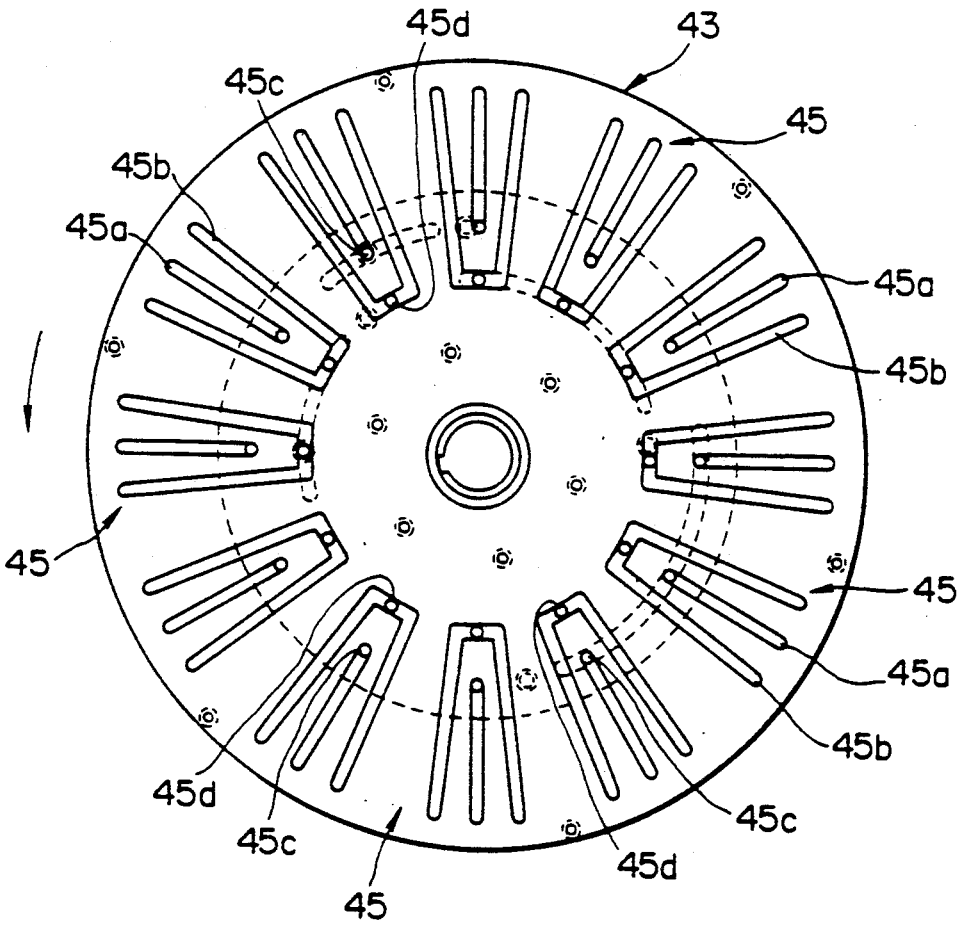
FIG. 8 is a rear elevational view of a vacuum manifold 43 shown in FIG. 3.
Figure 10:
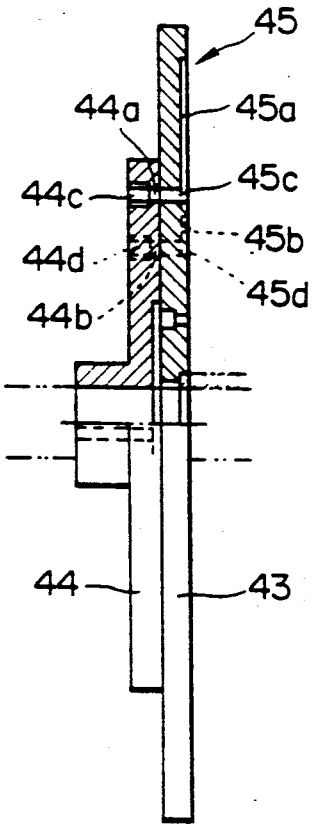
FIG. 10 is a side eleavational view in section of an upper portion of the vacuum manifold 43 and the vacuum disk 44 fit together.

As shown in FIGS. 8 and 10, the vacuum manifold 43 has a number of vacuum passages 45, facing toward the side plate 32, equivalent to the number of the rooms 31. Each vacuum passage 45 includes a V-shaped second passage **45*b* and a first passage 45*a* in the center of the second passage 45*b*. Both of the passage 45*a*, 45*b* reach to the other side of the vacuum manifold 43 through the first pass hole 45*c* and the second pass hole 45*d***.

Figure 9:
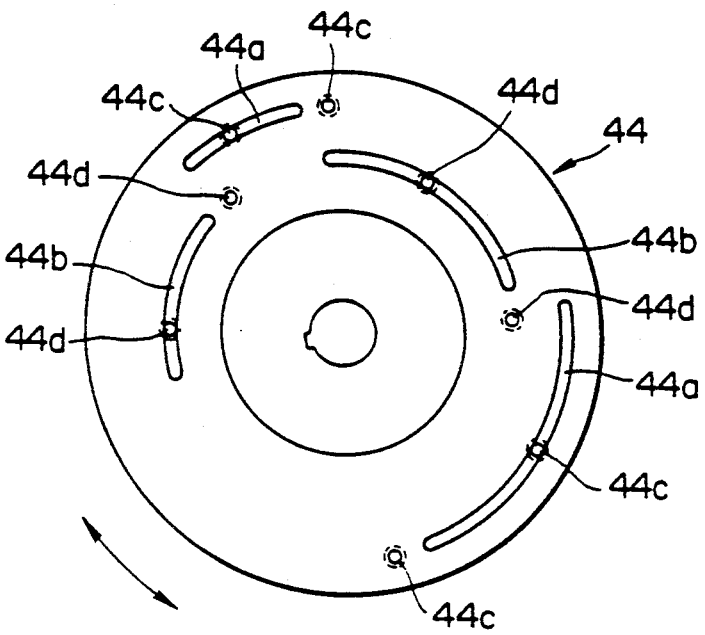
FIG. 9 is a elevational view of a vacuum disk 44 shown in FIG. 3.

The vacuum disk 44, as shown in FIGS. 9 and 10, has the first bypass **44*a* and the first opening 44*c*, both connected to the first passage 45*a*, and the second bypass 44*b* and the second opening 44*d*, both connected to the second pass hole 45*d*. As the vacuum disk 44 and the vacuum manifold 43 mutually rotate, interconnection and disconnection of the first passage 45*a*, the first bypass 44*a* and the first opening 44*c* can be accomplished. Also, as the vacuum disk 44 and the vacuum manifold 43 mutually rotate, interconnection and disconnection of the second passage 45*b*, the second bypass 44*b* and the second opening 44*d* can be completed. Therefore interconnection and disconnection between the sucking disks 38, 42** and the vacuum chamber can mechanically be achieved.

Figure 11:
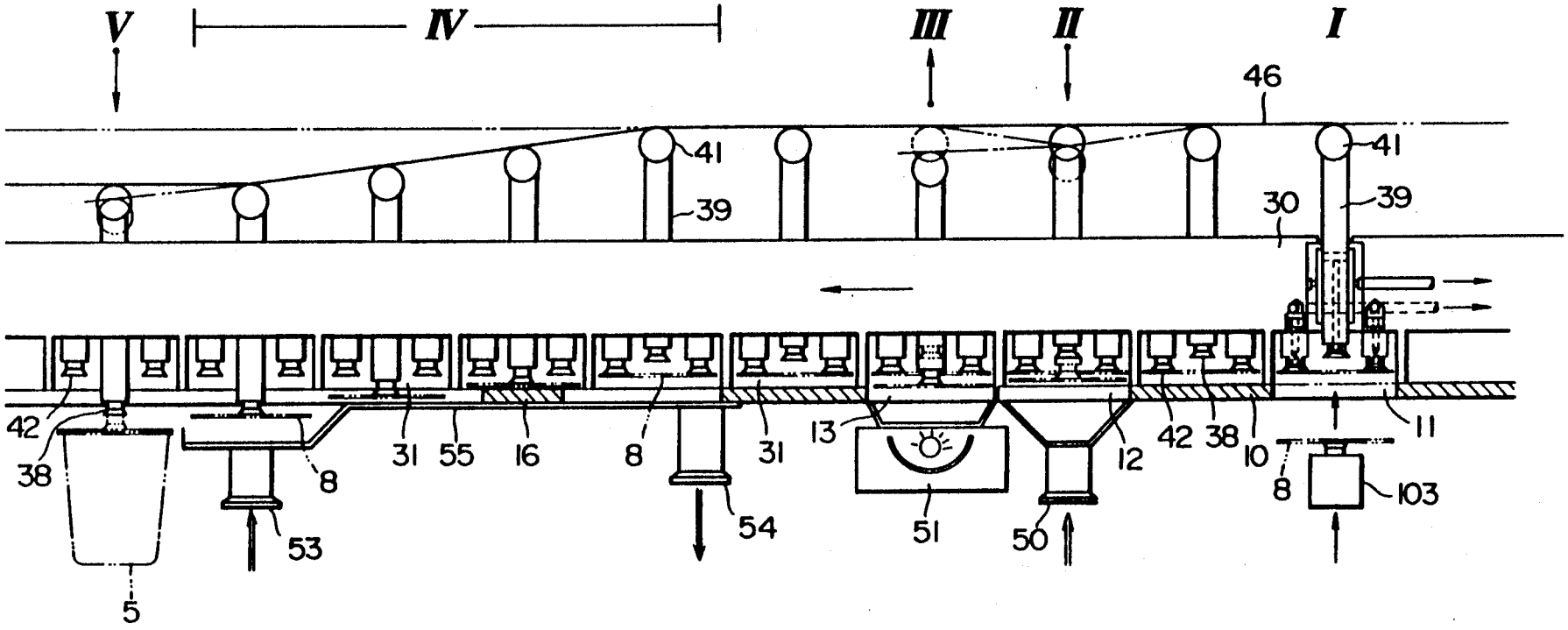
FIG. 11 is a development drawing that shows movement of sucking disks, 38, 42.

FIG. 11 shows the movement of the lid sterilization means 101. When a room 31 comes by the carry-in mouth 11 (position I), the first sucking disk moves back by elastic force of the spring 40 and as the cam wheel 41 follows the cam plate, and the lid 8 is sucked and held by the second sucking disk 42.

While room 31 is in the position I, the vacuum disk 44 rotates in one direction with the cam plate since both are mechanically connected to the cam driving shaft 47. And when the first sucking disk 38 is at the backing position, the first passage **45*a* which is a passage for the first sucking disk 38 is disconnected from the first bypass 44*a*, and the second passage 45*b* is interconnected with the second bypass 44*b* which is a passage for the second sucking disk 42. Thus, the lid 8 at this position can be held by the second sucking disk 42 and not by the first sucking disk 38**.

The room 31 then revolves and comes by the sterilizer apply mouth 12 (position II), where the sterilizer is applied to the room 31 through the sterilizer apply duct 50 and the lid 8 is sterilized. While the room 31 is at position II, the lid 8 is first held by the second sucking disk 42 and then by the first sucking disk 38 as the cam plate 46 and the vacuum disk 44 rotate in the return direction together. Therefore the, whole surface of the lid 8 can be exposed and sterilized.

The room 31 then moves up by the ultraviolet rays apply mouth 13 (position III) where the lid 8 is also held alternatively by the first sucking disk 38 and by the second sucking disk, so the whole surface of the lid 8 can be sterilized by the ultraviolet rays.

After the sterilization is done, the room 31 moves by the hot wind passage mouth 14, the drying zone (position IV), and there the lid 8 is completely dried. During the drying process, the lid 8 is first held by the second sucking disk 42 and then by the first sucking disk 38, so the whole surface of the lid 8 can be exposed and dried well.

When the room 31 comes by the carry-out mouth 15, the first sucking disk 38 moves upwardly to the downward direction and provides the lid 8 on top of the container 5. Providing the lid 8 by the first sucking disk 38 at its center and not by the second sucking disk 42 at its edge is advantageous when the lid 8 is temporarily sealed at the next procedure.

The temporal sealing means 102 is installed underneath the lid sterilization means 101. As shown in FIGS. 12 to 19, the moving rod 60, placed on the rail 7 and having the heater 61 at the end, is rotatably installed to the installation frame 79 with the moving shaft 63 and the shaft receiver 62 at the end. The moving arm 64 is firmly installed to the base end of the moving rod 60.

Figure 14:
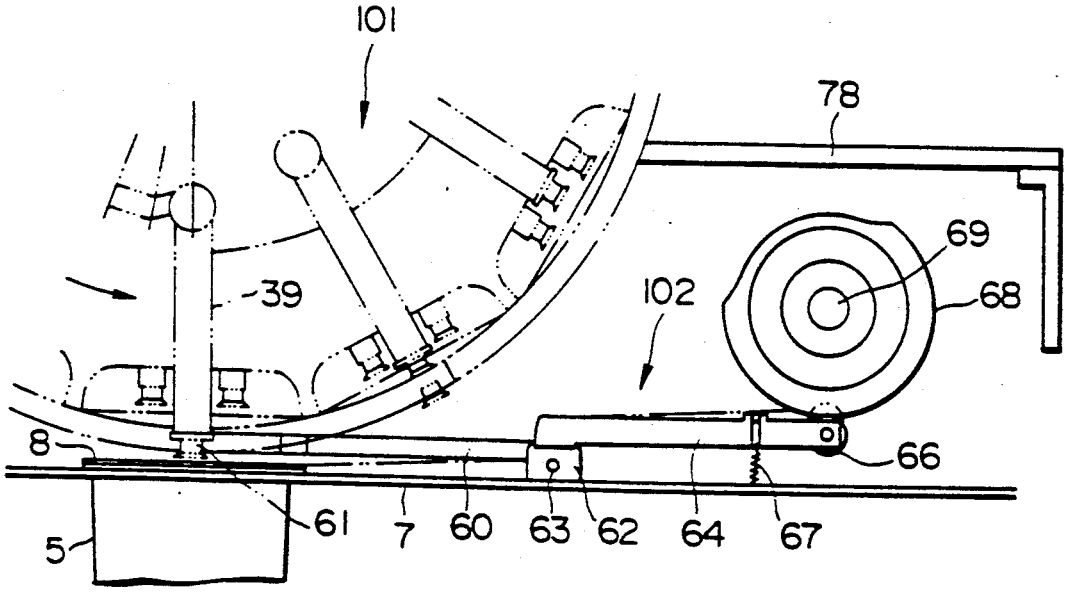
FIG. 14 is a elevational view of a preferred embodiment of the temporal sealing means 102.
Figure 15:
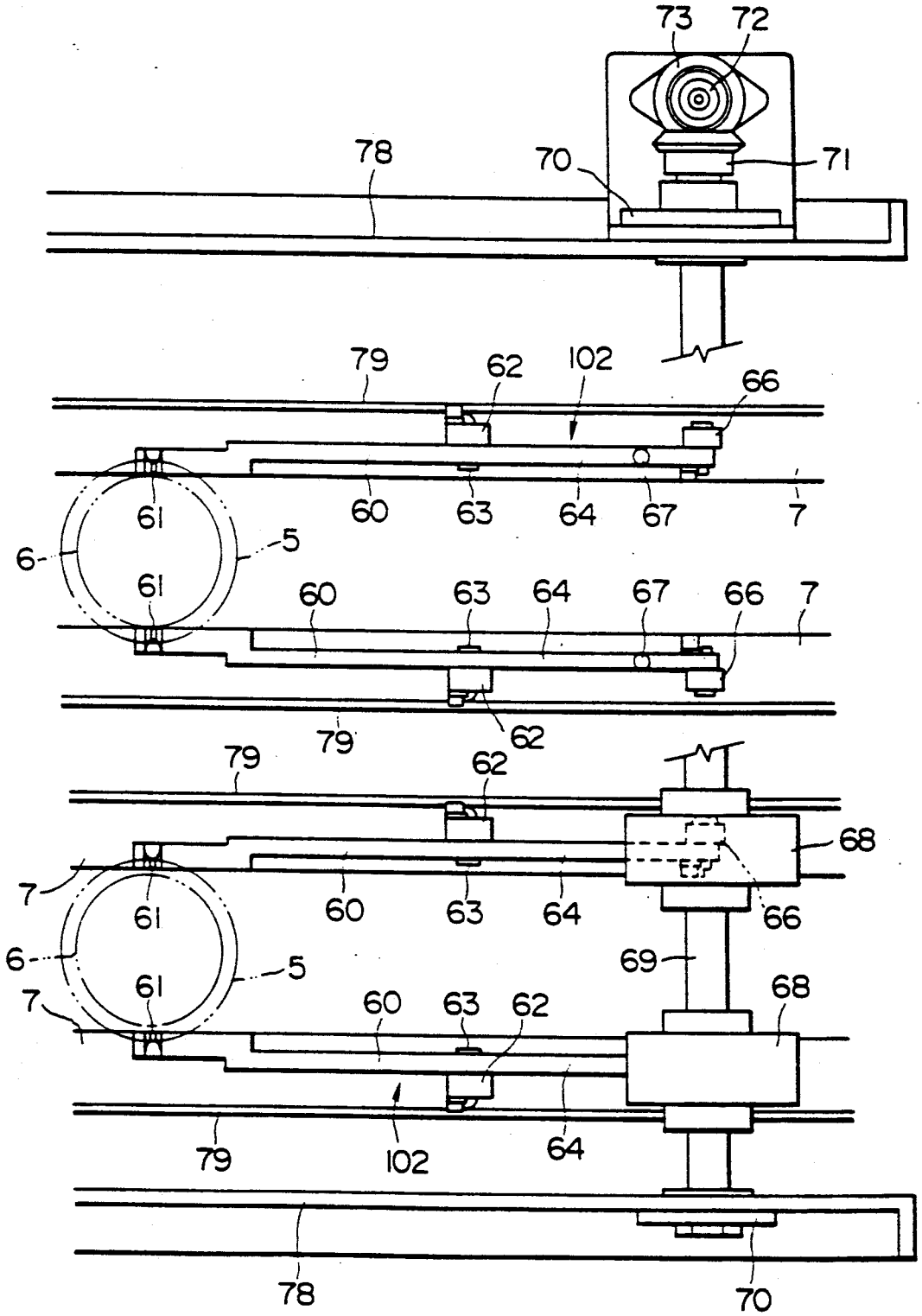
FIG. 15 is a top view, partly in section, of the same temporal sealing means 102.
Figure 16:
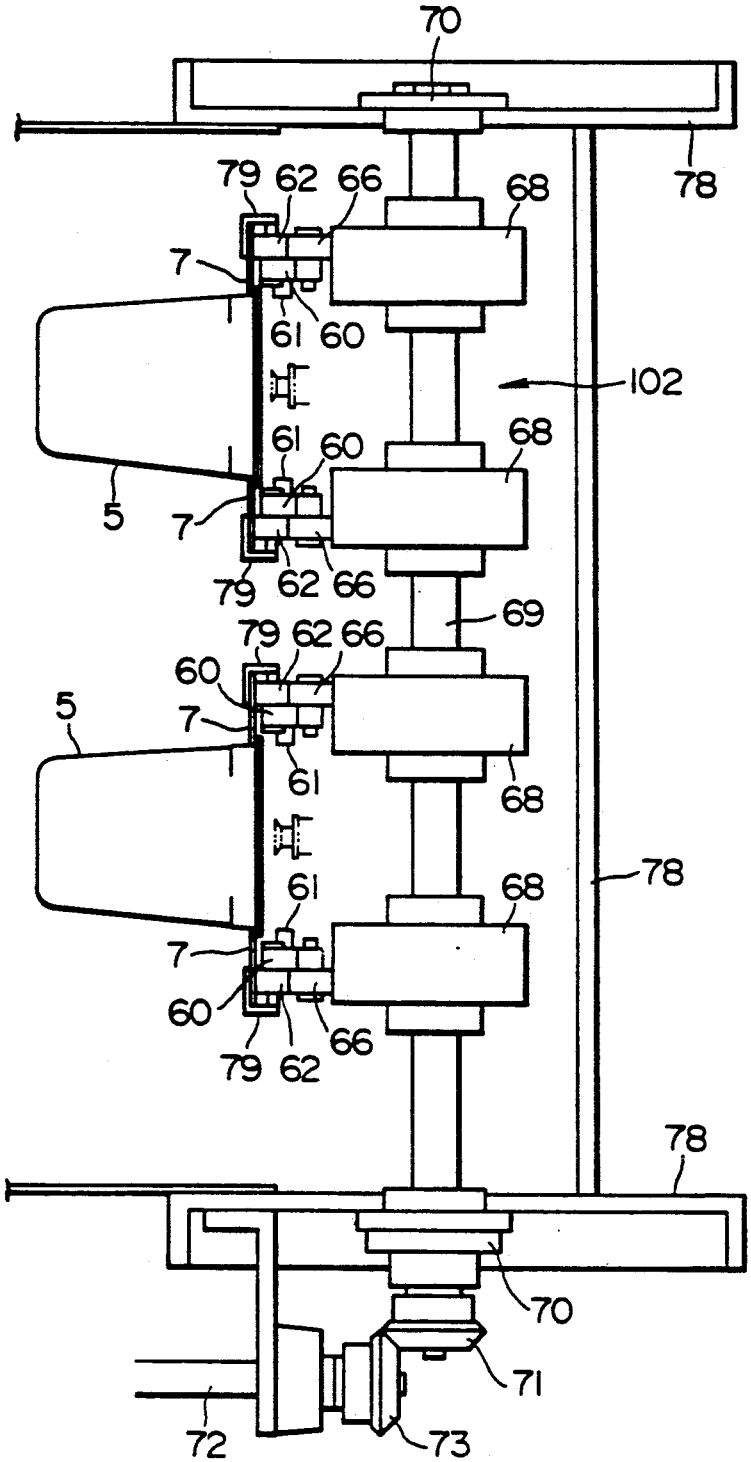
FIG. 16 is a side elevational view of the temporal sealing means 102 shown in FIG. 15.

FIGS. 14 to 16 show the temporal sealing means 102 which is driven with a cam structure. The coil spring 67 is placed between the moving arm 64 and the installation frame 79, and the cam follower 66 is rotatably provided at the end of the moving arm 64. The cam roller 68, whose center is rotatably installed to the rotary axis 69 that is attached to the fixed frame 78 with the bearing 70, is placed upper part of the cam follower 66. The cam roller 68 includes the bigger-diameter cam surface and the smaller-diameter cam surface.

The other end of the rotary axis is mechanically connected to the driving rod 72 through the follow gear 71 and the driving gear 73. The driving rod 72 is arranged to continuously rotate and its rotation is synchronized with the intermittent movement of the container 5 on the rail 7.

When the lid 8 is provided on the flange 6 of the container 5, the cam follower 66 runs on the cam roller's 68 smaller-diameter surface that enables the coil spring 67 to push the moving arm 64 upwardly. Thus the top end of the moving arm 64 downwardly moves and the heater 61 pushes the lid 8 onto the flange 6 of the container 5 and seals the lid 8 partially and temporarily.

After the sealing is completed, the cam follower 66 again runs on the bigger diameter surface of the cam roller 68. The moving arm 64 then is pushed downwardly and the heater 61 moves upwardly.

Concerning the above-explained cam structure, the cam's movement is mechanically synchronized with the movement of the container 5, therefore setting the timing of the sealing is easier and the sealing procedure can well be achieved.

Figure 17:
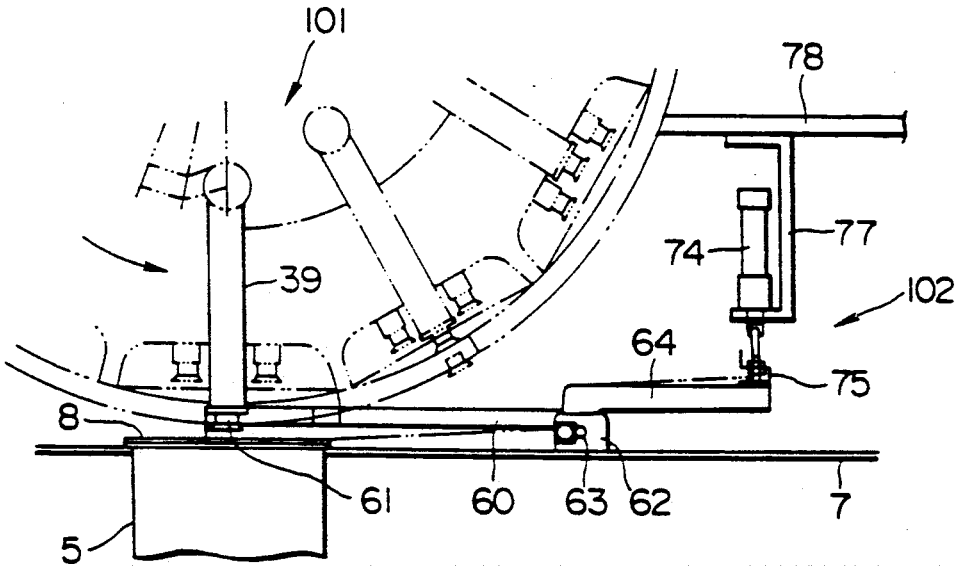
FIG. 17 is an elevational view of another preferred embodiment of the temporal sealing means 102.
Figure 18:
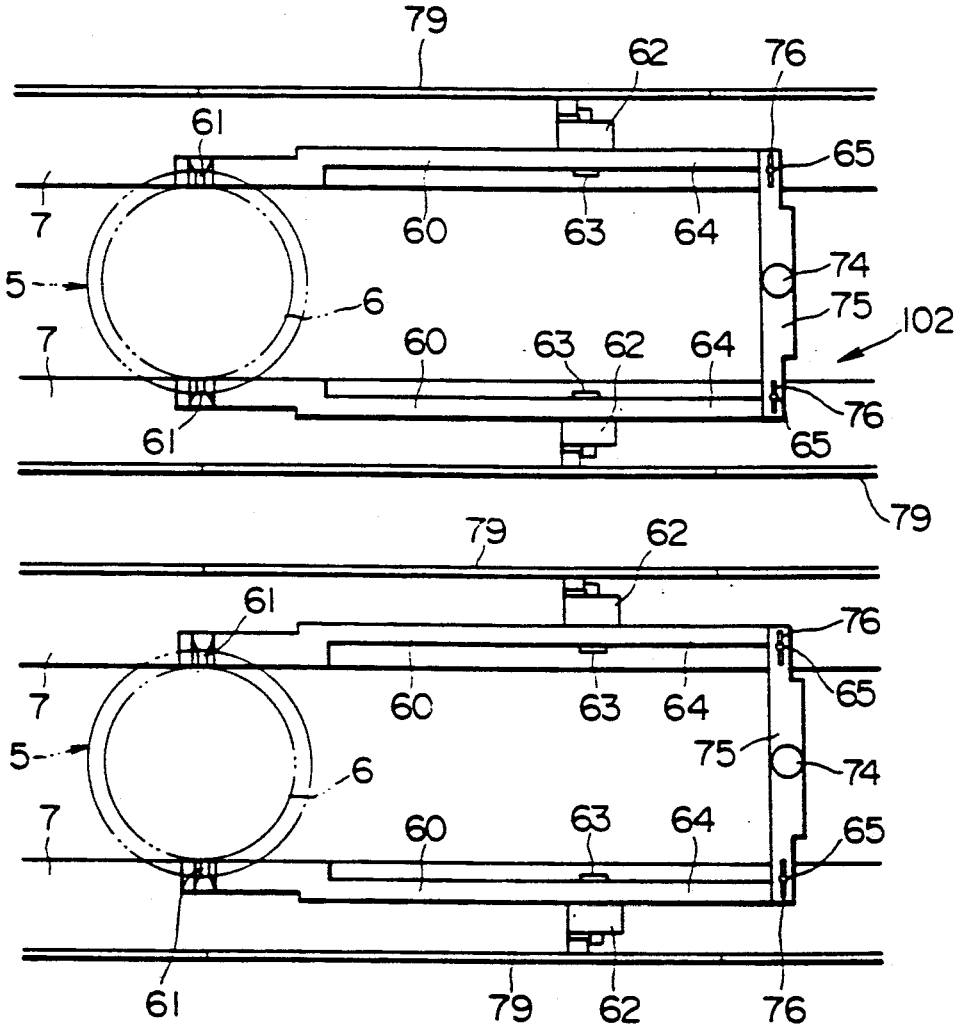
FIG. 18 is a top view, partly omitted, of the temporal sealing means shown in FIG. 17.
Figure 19:
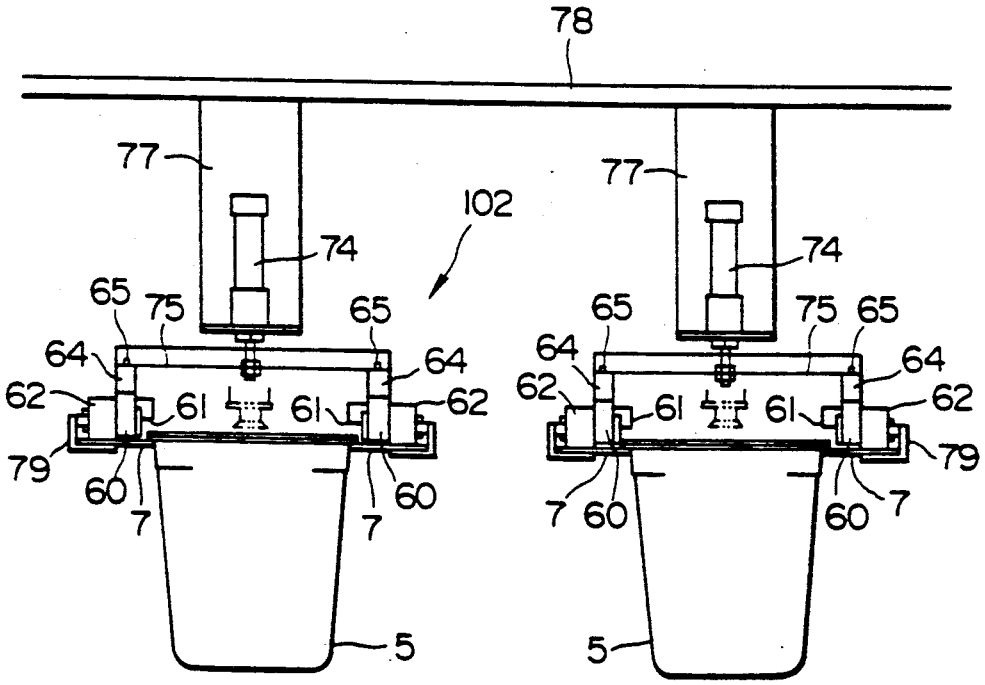
FIG. 19 is a side elevational view of the temporal sealing means shown in FIG. 17.

FIGS. 17 to 19 show the temporal sealing means 102 driven by a cylinder 74. The cylinder 74 is firmly fixed to the fixed frame 78 interconnected by the install frame 77, and the end of the cylinder rod is connected to the connecting plate 75 on the end of the moving arm 64. When a lid 8 is provided on the container 5, the cylinder 74 receives a signal and the cylinder rod moves upwardly and pulls up the moving arm 64. Thus, the top end of the moving rod 60 moves downwardly and the heater 61 pushes the lid 8 onto the flange 6 of the container 5 to temporarily seal it.

In this cylinder structure, the temporal sealing is done only after the container 5 reaches the right place and a lid 8 is correctly provided on the container 5. Therefore, if either one or both of the processes has not been successfully done, the sealing procedure will not proceed. The advantages of this structure are that the heater 61 will not directly touch the rail 7, thereby preventing damage of the rail 7 by heat, and that a test run of the temporal sealing means 102 can rather easily be done because the cylinder's 74 movement is not synchronized with the container's.

For the cam structure, the width of the cam roller 68 is much wider than the cam follower 66, and for the cylinder structure, the moving arm 64 and the connecting plate 75 are mechanically connected by inserting the pin 65 into the elongated hole 76. By this arrangement, when the width of the rail 7 is to be rearranged for a different size of container 5, the temporal sealing means 102 can easily be adjusted for the new size.

The remarkable effects of the present invention are as follows.

Since each room 31 in the lid sterilization means 101 is air tightly segregated from other rooms 31 and from the outside, the outside air, which contains germs, does not enter into the room 31 and the sterilizer does not leak.

A lid 8 is held by the sucking disk 38,42 in the room 31, so that any size lid 8 can be held by the same sucking disk 38,42. It is advantageous because the sucking disk does not have to be replaced by another one when a different sized lid 8 is to be sealed, and therefore the non-germ atmosphere can be maintained. As a result, a lot of time and work can be saved.

During the sterilization process, a lid 8 is held by the first sucking disk 38 and the second sucking disk 42 at different parts. Thus the, whole surface of the lid 8 is exposed and the whole surface can be sterilized.

Since a cylindrically shaped drum is used as a main element of the lid sterilization means 101, the intermittent movement can rather easily be achieved compared, for example, to a non-drum element. Therefore, it is possible to make the means simpler and more compact.

The first sucking disk 38 works during the sterilization process and drying process as a lid holder. It also works as a lid provider. Since the first sucking disk 38 is applicable to the both, it is not neccessary to install another means as a lid provider. This also makes the apparatus simpler and more compact. Moreover, since the lid 8 is held only by both sucking disks 38,42 and not by another element, the position of the lid 8 on the container 5 can be kept correctly. Therefore, another means that adjusts the position of the lid 8 on the container 5 is unneccessary.

Since interconnection and disconnection of the sucking disks 38,42 and the vacuum chamber is done by the rotational movement of the vacuum disk 44, which rotation is the same as that of the cam plate 46 the, sucking procedure of the sucking disks 38,42 can be accomplished.

The heater 61 of the temporal sealing means 102 is located right above the container 5 in the sealing position, thus temporal sealing can be done by only forcing the heater 61 downwardly onto the lid 8.

The width of the heater 61 is adjustable, so even when the rail's distance is widened or narrowed for a different sized container 5, the heater's 61 position can be adjusted easily.

What we claim is:

1. A method of temporal sealing comprising the steps of positioning a sterilized lid on an opening of a container, the container being hung at a flange thereof on at least a pair of rails which are movable relative to one another such that a distance between said rails can be varied and partially pressing said sterilized lid onto at least a part of said flange with a heater and temporarily sealing said sterilized lid to at least part of said flange.

2. A temporal sealing means having a space for a sterilized lid that is to be placed onto a container, and at least one heater secured to move upwardly, downwardly and laterally in said space to press said sterilized lid against a flange on said container for temporal sealing.

3. A temporal sealing means having a space for a sterilized lid that is to be placed onto a container, and a pair of heaters secured to move upwardly and downwardly in said space to press said sterilized lid against a flange on said container for temporal sealing, said heaters being arranged such that a distance between the heaters can be varied according to the distance between a pair of rails which can freely be set for different sized containers.

4. A temporal sealing means having a space for a sterilized lid that is to be placed onto a container, at least one heater secured to move upwardly and downwardly in said space to press said sterilized lid against a flange on said container for temporal sealing, and a moving rod, a base end of which is rotatably secured to enable a top end thereof to be at a temporal sealing position, said at least one heater being secured to said top end.

5. A temporal sealing means as claimed in claim 4, further comprising a moving arm secured to the base end of said moving rod, and a device installed to said moving arm to move said moving rod upward and downward.

6. A temporal sealing means as claimed in claim 5 which comprises:

a cam follower, a spring that gives elastic force to said moving arm in the upper direction, and a cam roller which is secured to a rotary axis, the cam roller intermittently rotating with intermittent movement of said container, a cam surface of said cam roller contacting said cam follower.

7. A temporal sealing means as claimed in claim 5 further comprising a cylinder that moves said moving arm upward and downward.

* * * * *